US011098861B1

(12) United States Patent
Wang

(10) Patent No.: US 11,098,861 B1
(45) Date of Patent: Aug. 24, 2021

(54) SUN UMBRELLA CAPABLE OF EMITTING LIGHT IN ALL DIRECTIONS

(71) Applicant: Linhai Guokang Leisure Products Co., Ltd., Taizhou (CN)

(72) Inventor: Ziguo Wang, Taizhou (CN)

(73) Assignee: Linhai Guokang Leisure Products Co., Ltd.

( * ) Notice: Subject to any disclaimer, the term of this patent is extended or adjusted under 35 U.S.C. 154(b) by 0 days.

(21) Appl. No.: 16/897,607

(22) Filed: Jun. 10, 2020

(51) Int. Cl.

| | |
|---|---|
| ***F21S 4/28*** | (2016.01) |
| ***F21S 9/02*** | (2006.01) |
| ***F21V 23/00*** | (2015.01) |
| ***F21V 23/06*** | (2006.01) |
| ***E04H 15/10*** | (2006.01) |
| ***E04H 15/28*** | (2006.01) |
| ***A45B 25/00*** | (2006.01) |
| ***A45B 23/00*** | (2006.01) |

(52) U.S. Cl.
CPC ..... *F21S 4/28* (2016.01); *A45B 23/00* (2013.01); *A45B 25/00* (2013.01); *E04H 15/10* (2013.01); *E04H 15/28* (2013.01); *F21S 9/02* (2013.01); *F21V 23/001* (2013.01); *F21V 23/06* (2013.01); *A45B 2200/1018* (2013.01)

(58) Field of Classification Search
CPC .. A45B 3/02; A45B 2200/1018; Y10S 135/91
USPC ..... 362/102
See application file for complete search history.

(56) References Cited

U.S. PATENT DOCUMENTS

| | | | | |
|---|---|---|---|---|
| 6,000,808 | A * | 12/1999 | Hansen | F21V 33/008 362/109 |
| 6,126,293 | A * | 10/2000 | Wu | A45B 3/04 362/102 |
| 6,837,255 | B2 * | 1/2005 | Bunch | A45B 3/04 362/102 |
| 8,297,294 | B2 * | 10/2012 | Li | A45B 3/00 362/102 |
| 2005/0254228 | A1 * | 11/2005 | Li | F21S 9/035 362/102 |
| 2007/0127231 | A1 * | 6/2007 | Li | F21S 9/035 362/102 |

* cited by examiner

*Primary Examiner* — William J Carter

(57) ABSTRACT

A sun umbrella capable of emitting light in all directions comprising an umbrella rod and an umbrella disc. The umbrella rod is connected to an opening-and-closing device and is internally provided with a light strip. Circuit boards are fixedly assembled in the umbrella disc. The opening-and-closing device comprises light-transmitting tubes. Each light-transmitting tube is internally provided with a light strip, and the light strip is electrically connected to a power supply through a circuit board. The light-transmitting tubes are directly used as umbrella ribs. Copper-wire lights are arranged in the umbrella rod and the umbrella ribs and are directly connected to the circuit boards assembled in the umbrella disc, thus avoiding slotting process and achieving a simple assembly. The power supply is detachable and the power supply is stable and reliable. Through adopting the technical solution of the present disclosure, the production capacity is improved, and the cost is lowered.

16 Claims, 4 Drawing Sheets

SUN UMBRELLA CAPABLE OF EMITTING LIGHT IN ALL DIRECTIONS

TECHNICAL FIELD

This disclosure generally relates to the technical field of sun umbrellas, and more particularly, to a sun umbrella capable of emitting light in all directions.

BACKGROUND

A sun umbrella is a leisure product used when traveling and vacationing. With the rapid development of tourism, parasols and hanging umbrellas are widely used in leisure places such as plazas, beaches, parks, and courtyards for providing a good shade to users.

Various sun umbrellas with a lighting function are sold on the market. Their ribs are slotted for receiving PCBs (printed circuit boards) with LED lights, and light-transmitting plates are installed on the PCBs. The PCBs with LED lights and the light-transmitting plates are fixed on the umbrella ribs through fasteners or choke plugs. The aforesaid design has basically replaced a conventional structure that lamp beads are assembled by drilling holes in the umbrella ribs. However, the costs of production and assembly are high, and all-directional light emission cannot be achieved.

SUMMARY

The purpose of the present disclosure is to provide a sun umbrella capable of emitting light in all directions, which achieves convenient production and assembly.

To achieve the above purpose, the present disclosure adopts the following technical solution: a sun umbrella capable of emitting light in all directions comprising an umbrella rod and an umbrella disc, wherein the umbrella rod is connected to an opening-and-closing device, and is internally provided with a light strip, wherein circuit boards are fixedly assembled in the umbrella disc, wherein the opening-and-closing device comprises a plurality of light-transmitting tubes, wherein each light-transmitting tube is internally provided with a light strip, and the light strip is electrically connected to a power supply through a circuit board.

In another aspect of the present disclosure, the light strip comprises a plurality of copper-wire lights, which are connected in series through an electric wire. The tail end of the electric wire is connected to a connecting block for connecting the circuit board.

In another aspect of the present disclosure, the umbrella rod is internally provided with a third light strip. The umbrella disc comprises an upper umbrella disc and a lower umbrella disc. A first circuit board and a second circuit board are respectively fixedly assembled in the upper umbrella disc and the lower umbrella disc. The light-transmitting tubes comprise a first light-transmitting tube and a second light-transmitting tube which are hinged through a hinge member. The first light-transmitting tube and the second light-transmitting tube are respectively internally provided with a first light strip and a second light strip.

In another aspect of the present disclosure, the connecting blocks of the first light strip and the third light strip are electrically connected to the first circuit board, and the connecting block of the second light strip is electrically connected to the second circuit board.

In another aspect of the present disclosure, the power supply is provided with a detachable storage battery and is fixed on the umbrella rod. A control switch is arranged on the power supply, the storage battery is provided with a USB charging port, and the power supply is electrically connected to a circuit board.

In another aspect of the present disclosure, the power supply is provided with a detachable storage battery and is fixed on the umbrella rod. A control switch is arranged on the power supply, and the storage battery is provided with a USB charging port. The power supply is electrically connected to the first circuit board, and the second circuit board is electrically connected to the first circuit board.

In another aspect of the present disclosure, one end of the first light-transmitting tube is hinged to the upper umbrella disc, and the other end of the first light-transmitting tube is connected to the umbrella cloth for supporting the umbrella cloth. One end of the second light-transmitting tube is hinged to the first light-transmitting tube through the hinge member, and the other end of the second light-transmitting tube is hinged to the lower umbrella disc.

In another aspect of the present disclosure, the second circuit board is electrically connected to the first circuit board through a wire.

In another aspect of the present disclosure, the umbrella rod and the light-transmitting tubes are made of a light-transmitting glass fiber tube material.

In the present disclosure, light-transmitting tubes are directly used as umbrella ribs; the copper-wire lights are directly connected to the circuit boards assembled in the umbrella disc, and are directly arranged in the umbrella rod and the umbrella ribs, thus avoiding the slotting process and achieving a simple assembly; the external power supply is detachable, the wire arrangement is reasonable, and the power supply is stable and reliable; through adopting the technical solution of the present disclosure, the production capacity is improved and the cost is lowered, fully meeting the demands of social development.

Marking Instructions of the Figures: 1—Umbrella Rod, 2—Power Supply, 21—Storage Battery, 22—USB Charging Port, 3—The Third Light Strip, 4—The Second Light Strip, 5—Wire, 6—The Second Circuit Board, 7—The First Light Strip, 8—The First Circuit Board, 9—The First Light-transmitting Tube, 10—The Second Light-transmitting Tube, 11—Copper-wire Light, 12—Electric Wire, 13—Connecting Block, 14—Hinge Member, 15—Opening-and-closing Device.

DETAILED DESCRIPTION

Figures are combined hereinafter to further elaborate the technical solution of the present disclosure.

Figure 1:
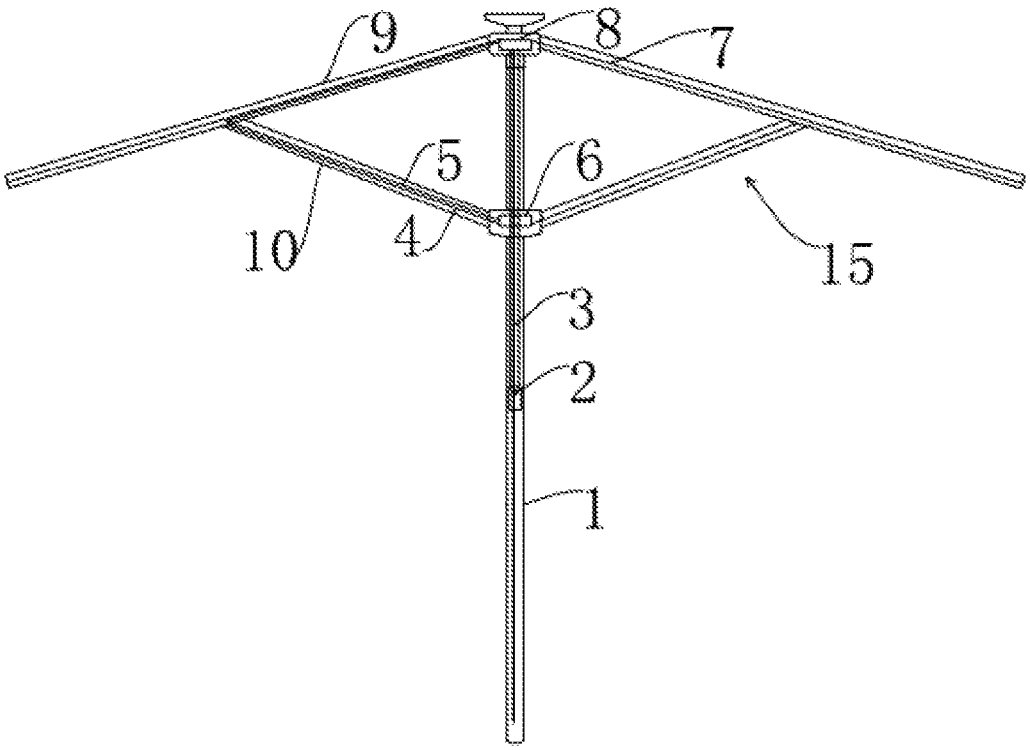
FIG. 1 is a conceptual diagram illustrating an example structure of the present disclosure.
Figure 2:
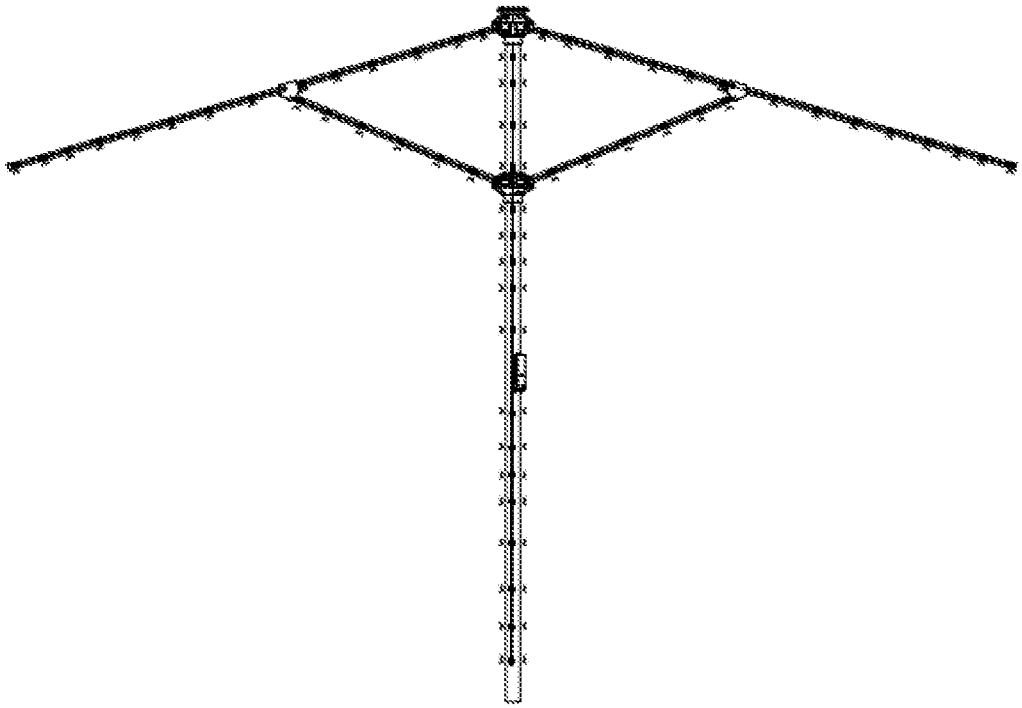
FIG. 2 is a conceptual diagram illustrating an effect of light emission.
Figure 3:
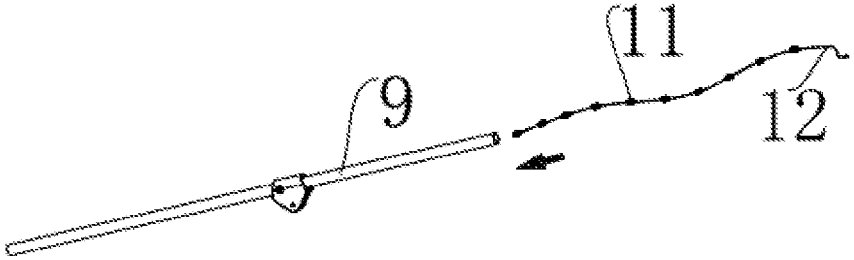
FIG. 3 is a conceptual diagram illustrating the wire arrangement of the copper-wire lights and the light-transmitting tube.
Figure 4:
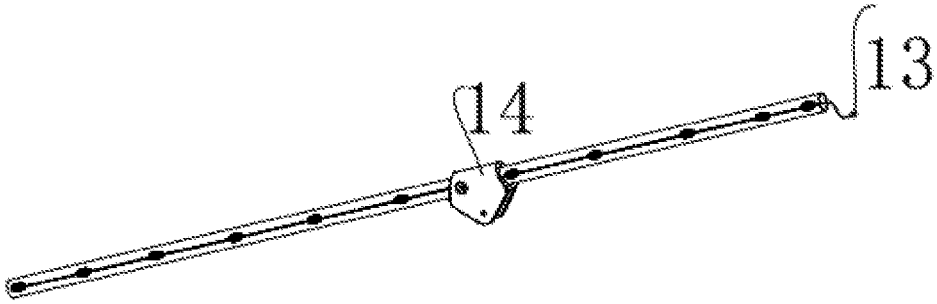
FIG. 4 is a conceptual diagram illustrating an assembled state of FIG. 3.
Figure 5:
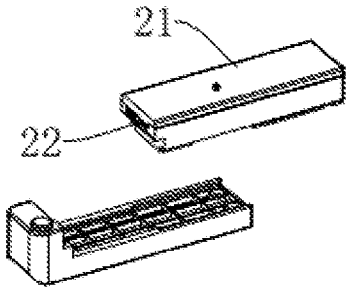
FIG. 5 is a conceptual diagram illustrating the assembly of the power supply.

As shown in FIGS. 1-5, a sun umbrella capable of emitting light in all directions comprises an umbrella rod 1 made of a light-transmitting glass fiber tube material and an umbrella disc internally provided with circuit boards. The umbrella rod 1 is connected to an opening-and-closing device 15 and is internally provided with a light strip. The opening-and-closing device 15 comprises a plurality of light-transmitting tubes also made of a light-transmitting glass fiber tube material, which are directly used as the umbrella ribs. Each light-transmitting tube is internally provided with a light strip, and the light strip is connected to a circuit board through an arranged circuit. The circuit boards are electrically connected to a power supply 2 through the arranged circuit, and the light emission of the light strips in the umbrella rod and the light-transmitting tubes is controlled through controlling the power supply.

The light strip is integrally formed by directly and serially connecting a plurality of copper-wire lights 11 using an electric wire 12. The tail end of the electric wire 12 is connected to a connecting block 13 for conveniently connecting a circuit board, which achieves a plug-and-play function and an easy assembly. The umbrella rod 1 is internally provided with a third light strip 3. Generally, the umbrella disc comprises an upper umbrella disc fixed on the umbrella rod 1 and a lower umbrella disc slidably fixed on the umbrella rod 1. A first circuit board 8 and a second circuit board 6 are respectively fixedly assembled in the upper umbrella disc and the lower umbrella disc. The light-transmitting tubes comprise a first light-transmitting tube 9 and a second light-transmitting tube 10, which are hinged through a hinge member 14. The first light-transmitting tube 9 and the second light-transmitting tube 10 are respectively and internally provided with a first light strip 7 and a second light strip 4. The connecting blocks 13 of the first light strip 7 and the third light strip 3 are electrically connected to the first circuit board 8, and the connecting block 13 of the second light strip 4 is electrically connected to the second circuit board 6.

The power supply 2 is provided with a detachable storage battery 21 and is fixed on the umbrella rod 1. A control switch is arranged on the power supply 2, the detachable storage battery 21 is provided with a USB charging port 22, and the power supply 2 is electrically connected to the first circuit board 8. As the second circuit board 6 slides on the umbrella rod 1 along with the lower umbrella disc, when the power supply 2 and the second circuit board 6 are connected, a wire 5 with a certain length must be reserved, resulting in an inconvenient wire arrangement. Additionally, after closing the umbrella using the lower umbrella disc for a prolonged period, the wire may be damaged. Therefore, in another preferred embodiment, the power supply 2 is directly electrically connected to the first circuit board 8, and the second circuit board 6 is electrically connected to the first circuit board 8 through the wire 5. One end of the wire 5 is connected to the first circuit board 8, and the other end of the wire 5 is connected to the second circuit board 6 after passing the first light-transmitting tube 9, the hinge member 14 and the second light-transmitting tube 10. In this way, a reasonable arrangement and a simple assembly are achieved.

One end of the first light-transmitting tube 9 is hinged to the upper umbrella disc, and the other end of the first light-transmitting tube 9 is connected to the umbrella cloth for supporting the umbrella cloth. One end of the second light-transmitting tube 10 is hinged to the first light-transmitting tube 9 through the hinge member 14, and the other end of the second light-transmitting tube 10 is hinged to the lower umbrella disc. Namely, the conventional long umbrella rib and the short umbrella rib are replaced by the first light-transmitting tube 9 and the second light-transmitting tube 10, which achieves a direct light transmission, avoids the slotting process, and makes the umbrella aesthetically pleasing.

The power supply 2 may be replaced by a solar panel, which may be installed on the top of the umbrella. The lighting mode may be turning on the first light-transmitting tube 9 or turning on the second light-transmitting tube 10, which may be determined according to users' needs.

The above embodiments are merely used for describing the present disclosure but not limiting the scope of the present disclosure. It should be noted that, based on the specification of the present disclosure, various improvements and modifications may be made according to actual needs by those skilled in the art without paying creative labor. Therefore, these improvements and modifications shall also fall into the scope of the present disclosure.

What is claimed is:

1. A sun umbrella capable of emitting light in all directions, comprising:

an umbrella rod, an upper umbrella disc, a lower umbrella disc, an opening-and-closing device wherein the opening-and-closing device further comprises a plurality of first light-transmitting tubes, and a plurality of second light-transmitting tubes, wherein the plurality of first light-transmitting tubes is hinged to the upper umbrella disc, wherein the plurality of second light-transmitting tubes is hinged to the lower umbrella disc, wherein each first light-transmitting tubes is hinged to one second light-transmitting tubes through a hinge member, wherein the upper umbrella disc comprises a first circuit board, wherein the lower umbrella disc comprises a second circuit board, wherein each first light-transmitting tube is internally provided with a first light strip, and the first light strip is electrically connected to a power supply through the first circuit board, wherein each second light-transmitting tube is internally provided with a second light strip, and the second light strip is electrically connected to a power supply through the second circuit board.

2. The sun umbrella capable of emitting light in all directions of claim 1, wherein the first light strip comprises a plurality of copper-wire lights, which are connected in series through an electric wire, wherein the tail end of the electric wire is connected to a connecting block for connecting the circuit board.

3. The sun umbrella capable of emitting light in all directions of claim 2, wherein the umbrella rod is internally provided with a third light strip.

4. The sun umbrella capable of emitting light in all directions of claim 3, wherein connecting blocks of the first light strip and the third light strip are electrically connected to the first circuit board, and connecting block of the second light strip is electrically connected to the second circuit board.

5. The sun umbrella capable of emitting light in all directions of claim 4, wherein the power supply is provided with a detachable storage battery and is fixed on the umbrella rod, wherein a control switch is arranged on the power supply, wherein the detachable storage battery is provided with a USB charging port, wherein the power supply is electrically connected to the first circuit board, wherein the second circuit board is electrically connected to the first circuit board.

6. The sun umbrella capable of emitting light in all directions of claim 5, wherein the second circuit board is electrically connected to the first circuit board through a wire.

7. The sun umbrella capable of emitting light in all directions of claim 1, wherein the umbrella rod and the plurality of light-transmitting tubes are made of a light-transmitting glass fiber tube material.

8. The sun umbrella capable of emitting light in all directions of claim 5, wherein the umbrella rod and the plurality of light-transmitting tubes are made of a light-transmitting glass fiber tube material.

9. The sun umbrella capable of emitting light in all directions of claim 4, wherein the umbrella rod and the plurality of light-transmitting tubes are made of a light-transmitting glass fiber tube material.

10. The sun umbrella capable of emitting light in all directions of claim 3, wherein one end of the first light-transmitting tube is hinged to the upper umbrella disc, and other end of the first light-transmitting tube is connected to umbrella cloth for supporting the umbrella cloth, wherein one end of the second light-transmitting tube is hinged to the first light-transmitting tube through the hinge member, and other end of the second light-transmitting tube is hinged to the lower umbrella disc.

11. The sun umbrella capable of emitting light in all directions of claim 10, wherein the umbrella rod and the plurality of light-transmitting tubes are made of a light-transmitting glass fiber tube material.

12. The sun umbrella capable of emitting light in all directions of claim 3, wherein the umbrella rod and the plurality of light-transmitting tubes are made of a light-transmitting glass fiber tube material.

13. The sun umbrella capable of emitting light in all directions of claim 2, wherein the umbrella rod and the plurality of light-transmitting tubes are made of a light-transmitting glass fiber tube material.

14. The sun umbrella capable of emitting light in all directions of claim 1, wherein the power supply is provided with a detachable storage battery and is fixed on the umbrella rod, wherein a control switch is arranged on the power supply, wherein the detachable storage battery is provided with a USB charging port, wherein the power supply is electrically connected to the circuit board.

15. The sun umbrella capable of emitting light in all directions of claim 14, wherein the umbrella rod and the plurality of light-transmitting tubes are made of a light-transmitting glass fiber tube material.

16. The sun umbrella capable of emitting light in all directions of claim 1, wherein the umbrella rod and the plurality of light-transmitting tubes are made of a light-transmitting glass fiber tube material.

* * * * *